US008172730B2

(12) United States Patent
Emmert

(10) Patent No.: US 8,172,730 B2
(45) Date of Patent: May 8, 2012

(54) STILT DEVICES WITH COMMON LEG SUPPORT ASSEMBLIES

(75) Inventor: Raymond L. Emmert, Humaco, PR (US)

(73) Assignee: Emmert Second Limited Partnership, Humacao, PR (US)

( * ) Notice: Subject to any disclaimer, the term of this patent is extended or adjusted under 35 U.S.C. 154(b) by 0 days.

(21) Appl. No.: 12/628,498

(22) Filed: Dec. 1, 2009

(65) Prior Publication Data

US 2011/0130251 A1 Jun. 2, 2011

(51) Int. Cl.
*A63B 21/00* (2006.01)

(52) U.S. Cl. ..... 482/75; 482/76; 248/354.1; 267/64.28; 36/7.7; 36/7.6

(58) Field of Classification Search ..... 482/75, 482/76; 248/354.1; 267/64.28; 36/7.7, 7.6
See application file for complete search history.

(56) References Cited

U.S. PATENT DOCUMENTS

| | | | |
|---|---|---|---|
| 2,736,902 | A | 3/1956 | Bass |
| 2,747,300 | A | 5/1956 | Field |
| 2,802,217 | A | 8/1957 | Wilhoyte |
| 2,837,335 | A | 6/1958 | Koenig |
| 3,058,120 | A | 10/1962 | Smith et al. |
| 3,102,272 | A | 9/1963 | Emmert |
| 3,346,882 | A | 10/1967 | Wilhoyte |
| 3,626,519 | A | 12/1971 | Baker |
| 3,902,199 | A | 9/1975 | Emmert |
| 4,415,063 | A | 11/1983 | Hutchison |
| 5,645,515 | A | 7/1997 | Armstrong et al. |
| 6,517,586 | B2 | 2/2003 | Lin |
| 7,108,640 | B2 | 9/2006 | Emmert |

*Primary Examiner* — Jerome w Donnelly
(74) *Attorney, Agent, or Firm* — Hall Estill Attorneys at Law

(57) ABSTRACT

A stilt device having a front extendible strut and a cooperating rear extendible strut pivotally connected to a base member and a shoe plate, the front and rear extendible struts being disposed in a parallelogram relationship. The rear extendible strut has a rear member and a rear extendible member. A leg support pole is supported at one end by the rear extendible member and extends for its other end to be connected to a workman's leg to provide stability and to thereby enable the replacement of height determining extendible members, the distance from the shoe plate being a common vertical difference that is unchanged the extension of the extendible struts or by components thereof. For stilts of increased height the springs of the damping assemblies are selectively stiffened.

28 Claims, 5 Drawing Sheets

STILT DEVICES WITH COMMON LEG SUPPORT ASSEMBLIES

BACKGROUND

Stilt devices enable a workman to perform work at an elevated height above a base surface. Such devices are often used in the construction industry to facilitate operations several feet above the ground or floor level which would not otherwise be reachable without a scaffold, ladder or other support structure.

A number of useful stilt devices are known in the art, such as taught in U.S. Pat. Nos. 3,902,199 and 7,108,640, assigned to the assignee of the present application. Such stilts may be configured to be adjustable in height over a selected range through the use of telescopic struts. Different models of stilts can further be used to provide different ranges of adjustability. For example, one model of stilts may be provided that can be incrementally adjusted from a lower height of 12 inches to an upper height of 24 inches, whereas a different model of stilts may accommodate increments of from 24 to 40 inches, etc.

The types of elements employed in these respective types of stilt models may be similar, in that various models may all have shoe plates, floor plates, leg attachment assemblies and so on, each model may nevertheless have different mechanical configurations to accommodate different heights (and different height adjustment ranges). This can present difficulties in providing adequate adjustment ranges and other characteristics for the various models.

SUMMARY

The present invention provides preferred embodiments of an improved stilt device for supporting a workman at a selected working elevation above a base support surface. The stilt device has a first extendible strut having a first member and a cooperating first extension member that has one end extending into the first member. A second extendible strut in like manner has a second member and a cooperating second extension member that has one end extending into the second member. These members are disposed in parallelogram relationship with a base plate and a shoe plate, each of which is pivotally connected to opposing ends of the first and second extendible struts.

A damping assembly is connected between the first and second extendible struts and serves to bias these members to assume upright positions. A leg attachment assembly extends from proximity of the lower leg of the workman and has a leg support pole connected to the second member, and with attachment to the leg, stabilizing the workman and providing the capability of altering the range of elevation by replacement with other selected lengths of the extension members.

In one preferred embodiment, wherein the stilt has an increased height, a damping assembly is provided having an adjustable upper spring for forward walking motion and an adjustable lower spring for rearward walking motion, the upper spring is selectively constructed to operate to a force range of about 70 to 120 lbs. and the lower spring is selectively constructed to operate to a force range of about 40 to 80 lbs.

Further, the leg support pole preferably supports a leg clamp that has a pair of curved leg plates and a fastener strap for attaching the upper end of the leg support pole to the leg. Further, a medial portion of the leg support pole is adjustably attached to the shoe plate.

These and various other features and advantages which characterize the claimed invention will be apparent from a reading of the following detailed description and a review of the associated drawings.

DETAILED DESCRIPTION

Numerous possible variations and modifications will readily occur to the skilled artisan upon a review of the following discussion. Thus, it will be understood that the various exemplary embodiments disclosed herein are illustrative of, and are not limiting to, the scope of the invention.

Figure 1:
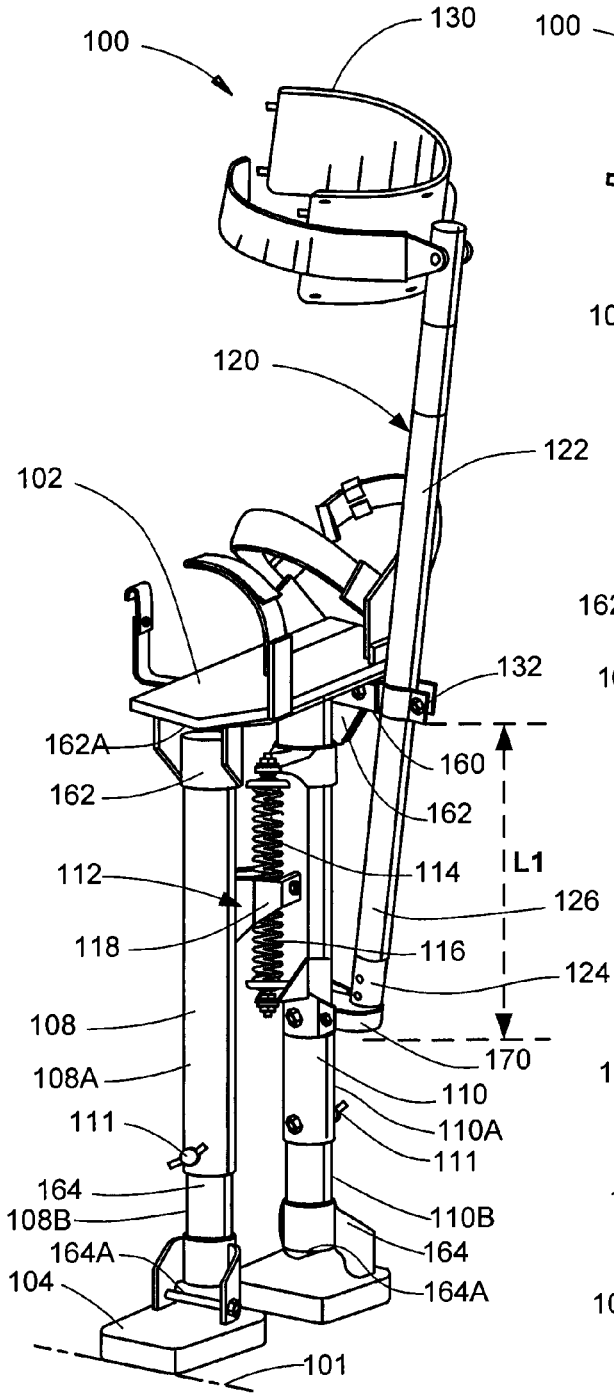
FIG. 1 is a front isometric view of a preferred embodiment of the stilt device of the present invention.
Figure 2:
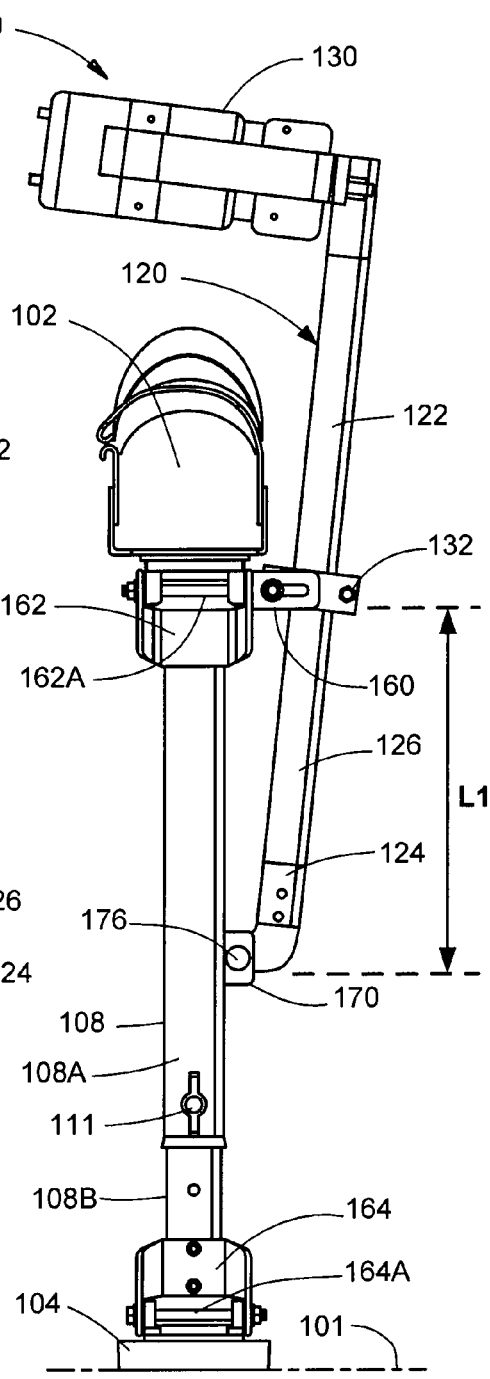
FIG. 2 is front elevation view of the stilt device of FIG. 1.

FIGS. 1 and 2 show a stilt device 100 that is one of a pair of such stilts that are designed to be attached to the legs of a user for the purpose of supporting the user above a base support surface 101, such as a floor. A normally horizontal foot or shoe plate 102 is configured to attach to a shoe or boot worn by the user, and a base member 104, also sometimes herein referred to as a floor plate, is provided to contact the support surface 101, a front extendible strut 108 and a rear extendible strut 110 pivotally attached to the base member and extending upward from the base member 104 to pivotally support the shoe plate 102.

The front extendible strut 108 and the rear extendible strut 110 are preferably telescoping assemblies that permit selective adjustment to their lengths, and thus, to the height that a pair of the stilt devices 100 will elevate the wearing user. A plurality of axially aligned holes are provided in the extendible struts 108, 110, and fasteners 111 can be positioned in selected ones of such holes, allowing the user to selectively adjust and fix the lengths of the struts 108, 110, thereby determining the height of the shoe plate 102 above the base support surface 101. Furthermore, as will be discussed below, the stilt device 100 can be assembled with varying lengths of the extendible struts 108, 110 to change the range of heights to be served by different models of stilt devices 100, changing the range of elevation capability.

Continuing with the description of the stilt device 100, a damping assembly 112 interconnects the front and rear extendible struts 108, 110 to position the extendible struts 108, 110 in the parallelogram relationship depicted in FIG. 1, and to bias the extendible struts 108, 110 to assume the upright position depicted. The damping assembly 112 comprises upper and lower damping springs 114, 116 that are affixed by brackets to the rear extendible strut 110 and to a rigid actuator arm 118; the actuator arm 118 is attached to, and extends from, the front extendible strut 108 to a medial position between the springs 114, 116.

The damping assembly 112, in addition to maintaining the parallelogram relationship of the extendible struts 108, 110, provides flexibility and cushioning to the user by permitting limited forward and rearward pivoting of the extendible struts 108, 110 with respect to the shoe plate 102 and the base member 104 as user walking or other leg movement occurs. With the exceptions described herein below with regard to attachment to the upper and lower extendible struts 108, 110, and for the exceptional stilt heights described herein below, the damping assembly 112 operates in the same manner described in my U.S. Pat. Nos. 3,902,199 and 7,108,640, which are incorporated herein by reference.

A leg attachment assembly 120 has a telescopic leg support pole 122 that can be adjusted as desired to properly fit the user's leg length. The leg support pole 122 includes an inner sleeve 124 and an outer sleeve 126, with the lower end of the inner sleeve 124 attached to the rear extendible strut 110 by connector member 128 (see FIG. 5 described below). The leg attachment assembly 120 has a clam-shell assembly 130, or leg clamp, and a support attachment assembly 132. The leg clamp 130, supported by the upper end of the outer sleeve 126, attaches to the user's leg just below the knee and serves to stabilize the user's stance. The lateral extent and relative angle of the leg support pole 122 with respect to the shoe plate 102 are adjustable via the support attachment assembly 132 in the manner discussed in greater detail below. The pair of stilt devices 100 are generally configured in mirror fashion so that the leg support pole 122 will extend along the outside of each user leg.

Figure 3:
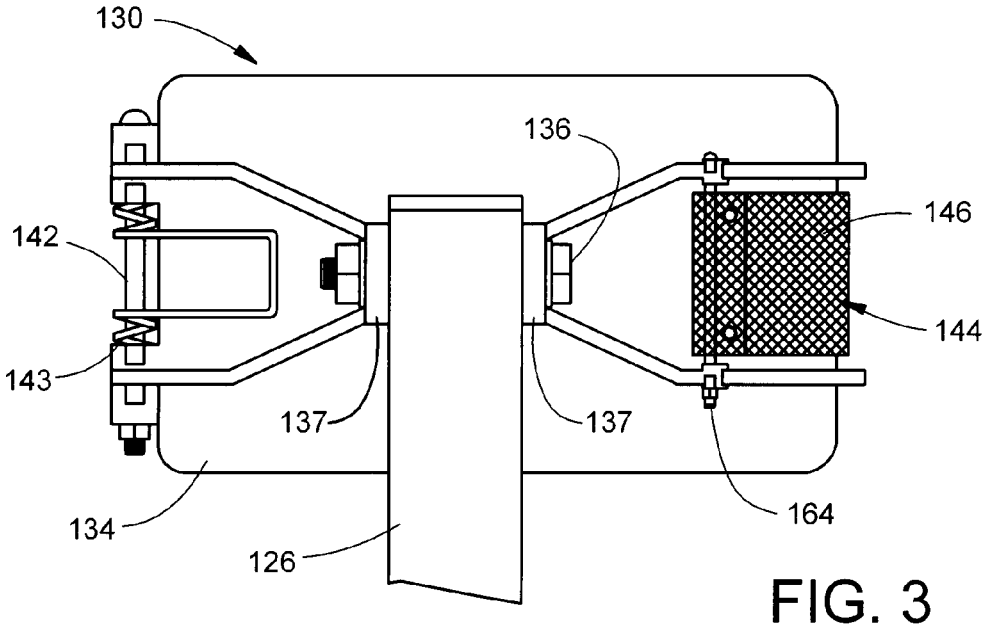
FIG. 3 is an outside elevation view of the leg clamp of the stilt device of FIG. 1.
Figure 4:
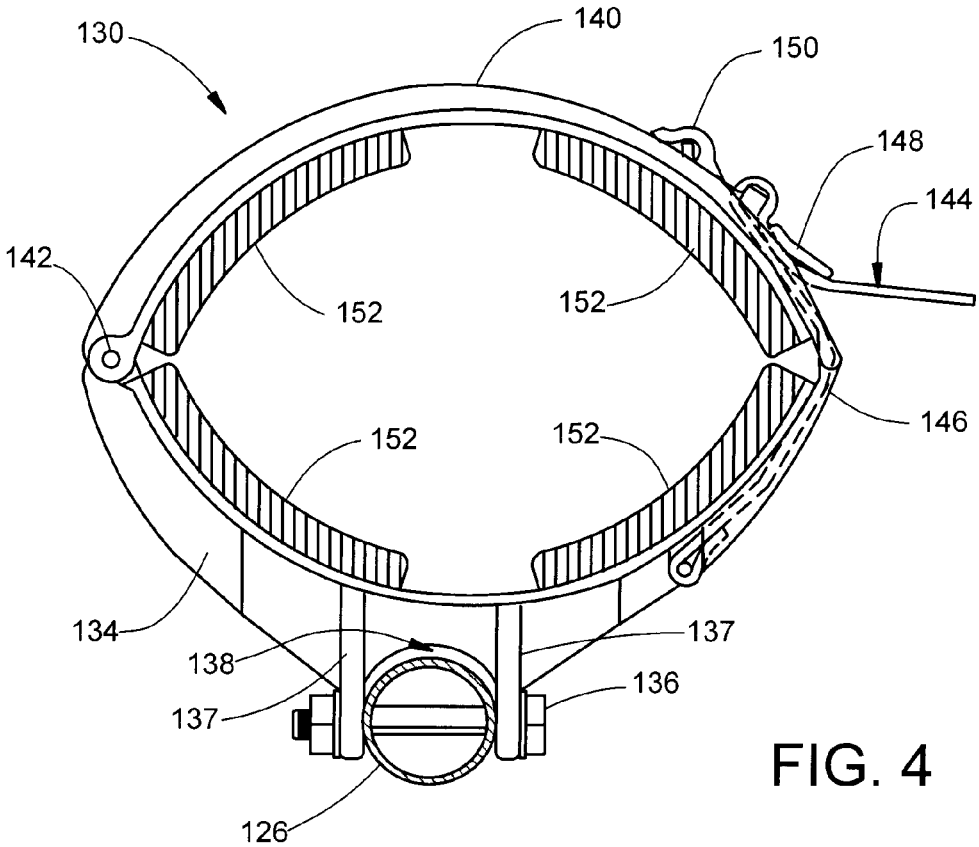
FIG. 4 is a top plan view of the leg clamp of FIG. 3.

As shown in FIGS. 3 and 4, the leg clamp 130 has a curved first leg plate 134 that is supported by the upper end of the outer sleeve 126 and is attached thereto by means of a bolt fastener 136 that extends through apertures of parallel wing extensions 137 and through axially aligned holes in the outer sleeve 126. The spaced apart extensions 137 provide a gap 138 that permits pivotal movement of the first leg plate 134 on the sleeve 126 for flexibility and comfort for the user.

A curved second leg plate 140 is disposed in facing relation to the first leg plate 134 and is pivotally connected thereto via a hinge pin 142. A biasing spring 143 may be provided to bias the second leg plate 140 to the closed position depicted in FIG. 4. A strap assembly 144 secures the first and second leg plates 134, 140 in the closed position around the user's lower leg, and includes a flexible strap 146 and a buckle 148. The strap 146 has one end affixed to the first leg plate 134 and engages the buckle 148 and its buckle tab 150 that are affixed to the second leg plate 140. Preferably, foam padding material 152 is adhered to the interior surfaces of the first and second leg plates 134, 140 to cushion the attachment to the user's leg. Further, the first and second leg plates 134, 140 are preferably made of a strong injection molded plastic or the like.

The support attachment assembly 132, as shown in FIGS. 1 and 2, includes a bracket 160 that grips around the outer sleeve 126 at a medial portion of the leg support pole 122 and extends to, and secures to, the underside of the shoe plate 102. The length of the leg support pole 122 can be adjusted by loosening the bracket 160 and changing the distance that the inner sleeve 124 extends from the outer sleeve 126, and then retightening the bracket 160.

The shoe plate 102 is pivotally attached to the upper ends of the extendible struts 108, 110 by extendible strut attaching brackets 162 and hinge pins 162A, and the shoe plate 102 is pivotally attached to the base members 104 by extendible strut attaching brackets 164 and hinge pins 164A. These four components—the parallel extendible struts 108, 110 and parallel shoe plate 102 and base member 104—are retained in parallelogram relationship as they pivot together.

The front and rear extendible struts 108, 110 serve as adjustable length legs for the stilt device 100. Each of the front extendible strut and the rear extendible struts 108, 110 is an extendible assembly. The front extendible strut 108 has an upper member 108A and a lower extension member 108B. The upper member 108A is an elongated outer sleeve member that is pivotally secured at its upper end to the shoe plate 102. The lower extension member 108B is an elongated member having its upper end disposed, and reciprocally slidable, within the upper member 108A. In like manner, the rear extendible strut 110 has an upper member 110A and a lower extension member 110B. The upper member 110A is an elongated outer sleeve member that is pivotally secured at its upper end to the shoe plate 102. The lower extension member 110B is an elongated member having its upper end disposed, and reciprocally slidable, within the upper member 110A. The lower ends, that is, the free ends, of the extension member 108B and 110B are pivotally connected to the base member 104.

Each of the extendible extension members 108B and 110B has several hole sets, any one set of which can be axially aligned with a set of axially aligned holes in the engaged member (108A, 110A) for receipt of a fastener 111 to rigidly establish the lengths of the extendible struts 108, 110. Preferably, the members 108A, 110A and the extension members 108B, 110B are shaped to have a circular or oval cross-section, but any selected cross-section shape will suffice as long as the cross-section shape and dimension of these members are correspondingly selected so that they can operate as extendible assemblies.

Figure 5:
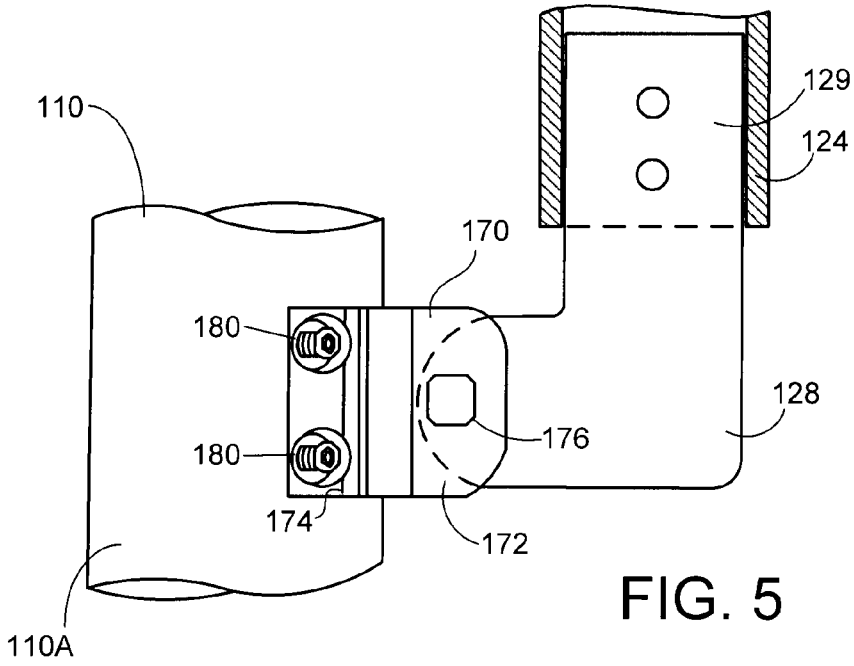
FIG. 5 is an enlarged elevation view of a bracket of the stilt device of FIG. 1.
Figure 5A:
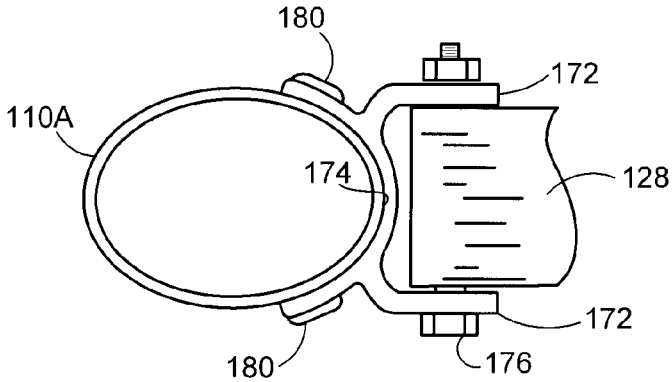
FIG. 5A is a top plan view of the bracket of FIG. 5.

Returning attention to the leg attachment assembly 120, it will be noted that the connector member 128 is attached to the rear extendible strut 110 by means of a non-capturing yoke bracket 170 that is shown in enlarged detail in FIGS. 5 and 5A. The bracket 170 has a pair of ear extensions 172 that are supported by an arcuately shaped base member 174 that is configured to fit the external shape of the member 110A of the extendible strut 110. The ear extensions 172 have axially aligned apertures (not separately numbered) for receipt of a bolt fastener 176 that extends through an aperture of the connector member 128.

An upper portion 129 of the connector member 128 extends into the lower end of the inner sleeve 124 and is attached thereto by bolts (not shown). Of course, it will be recognized that the lower end of the inner sleeve 124 can be swaged to be formed into the shape of the connector 128 so that the connector is an integral portion of the inner sleeve 124. Fastener members 180 extend through apertures (not separately numbered) in the base member 174 and extend into appropriately positioned apertures 182 in the member 110A to attach the bracket 170 thereto.

Figure 5B:
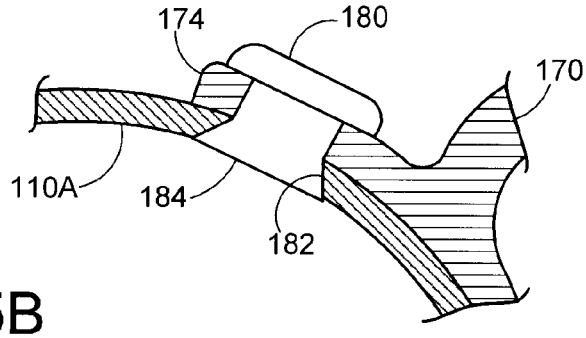
FIG. 5B is an enlarged, partially cutaway view of the fastener member securing the bracket of FIG. 5.
Figure 8:
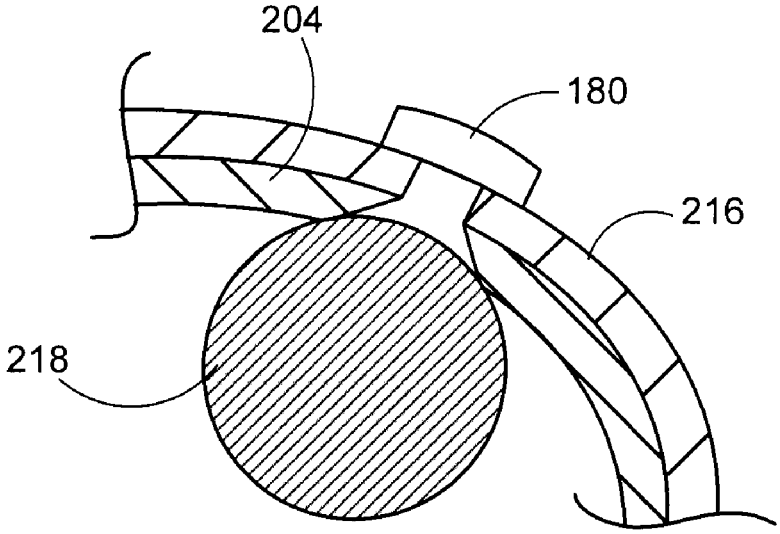
FIG. 8 illustrates the attachment of the damping assembly to the outer tubular member.

FIG. 5B, an enlarged, partially cutaway cross-section, shows that the ends of the fasteners 180 do not protrude into the hollow of the upper member 110A, as such hollow interior must serve as a clear, unhindered sliding channel for the free travel of the lower extendible member 110B. Thus, the ends of the fasteners 180 are flush with, or slightly recessed from, the inner wall surface of the member 110A. Each aperture 182 is tapered to enlarge at the inner wall of the member 110A, and the end 184 of each fastener 180 is swaged or flared to be flush with, or slightly recessed from, the inner wall of the member 110A. In practice, the fasteners 180 can be rivet members that are press formed by a crimper forcing the fasteners 180 against an internally positioned backup anvil (as depicted in FIG. 8 discussed below) to flush the ends 184 within the tapered apertures 182.

The flush or slightly recessed mounting of all fasteners that penetrate the walls of the extendible struts 108, 110, such as the above described fasteners 182 (with exception of the fasteners 111), is desirable, as this provides unimpeded sliding access for the extension members 108B, 110B along the full lengths of the members 108A, 110A.

With reference to FIGS. 1-2, it will be noted that the bracket 170 is attached to the rear extendible strut 110 via the connector 128 and spaced below the damping assembly 112. The bracket 170 could be alternatively located elsewhere such as within the damping assembly 112. While the exact positioning of the bracket 170 on the rear extendible strut 110 is not critical, the attachment of the leg attachment assembly 120, and particularly the lower end of the leg support pole 122, to the extension member 110A, serves to stabilize the stilt user and provides the capability of altering the range of elevation for different models by the singular step of replacing the front and rear extendible struts 108, 110 with like members of varying selected lengths. For the purpose of illustrating this, the distance between the bracket 160 and the point of attachment of the bracket 170 to the member 110A is designated as "L1" for the present description.

Figure 6:
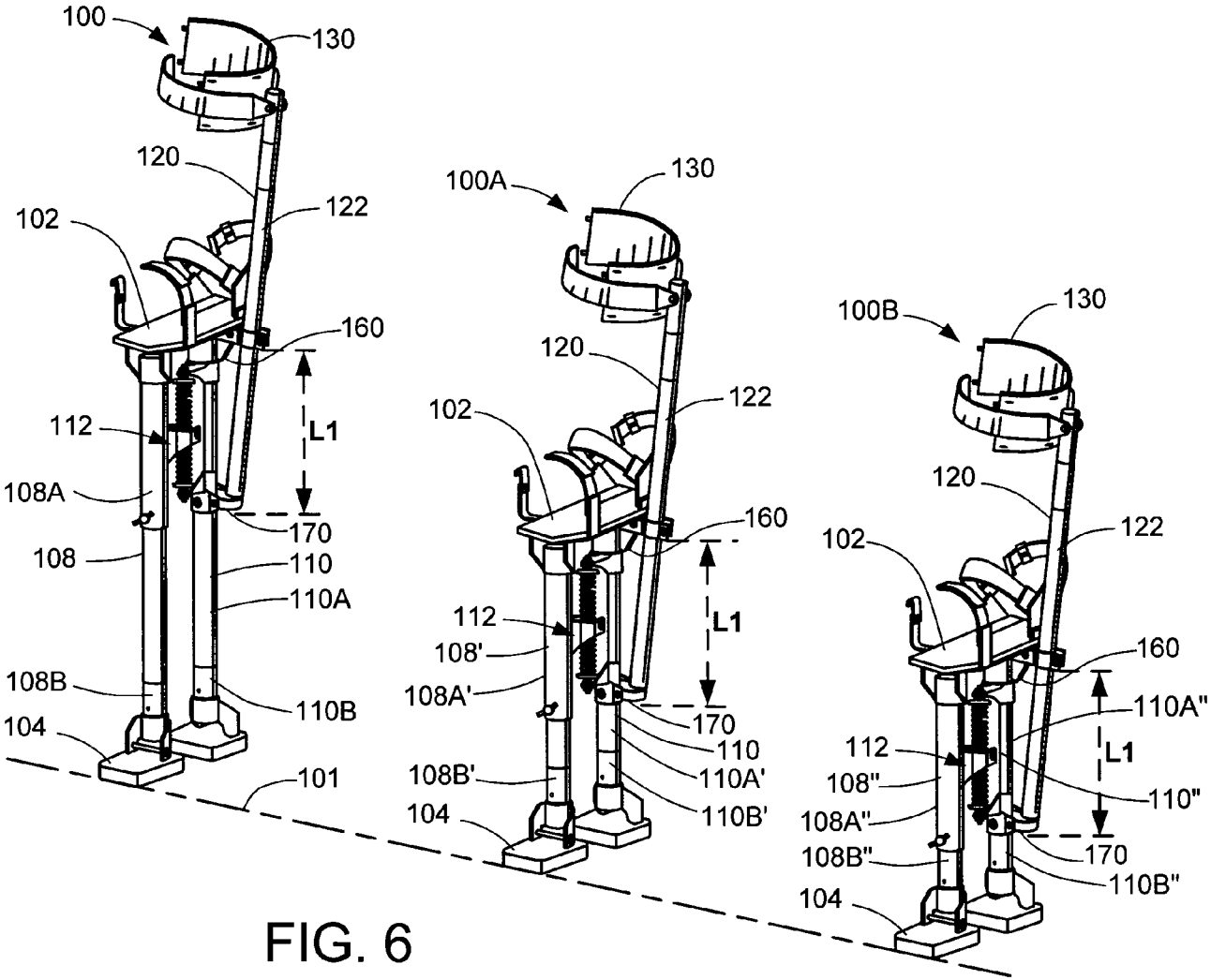
FIG. 6 displays three embodiments of the stilt device of the present invention, with a front isometric view shown of each embodiment.

Turning now to FIG. 6, depicted therein are three embodiments of the stilt device of the present invention. Shown in side by side display with each setting on the common base support surface 101, stilt devices 100, 100A and 100B are set up for a common workman to work at different elevations. The stilt devices 100, 100A and 100B are identically constructed except as will be described, and identical numbers are used to designate identical components as that described herein above for the stilt device 100.

It will be noted that in each of the stilt devices 100, 100A and 100B, the attachment of the bracket 170 to the supporting rear extendible strut 110 is the same distance L1. That is, as with the stilt device 100, the bracket 170 for the stilt device 100A is attached to the rear extendible strut 110A at the distance L1 as measured from the bracket 160, and the bracket 170 for the stilt device 100B is attached to the rear extendible strut 110A" at the distance L1 measured from the bracket 160.

The point to note is that the lengths of the front and rear extendible struts 108, 110 are different in each of the stilt devices 100, 100A and 100B, but the attaching point of the bracket 170 is at the same distance L1 below the bracket 160. With the exceptions to be described, the components of the stilt devices 100, 100A and 100B are identical and interchangeable. The only differences between the three stilt devices 100, 100A and 100B are the lengths of the struts 108B, 108B', 108B" and struts 110B, 110B', 110B", respectively. Thus, in each of the stilt devices the lengths of the front and rear extendible struts is adjustable within a range of extension that is determined by the lengths of the component members thereof. This is a valuable feature of the present invention, as this permits the stilt devices to serve different elevation ranges for the workman who will be wearing the stilt devices.

In addition to the capability of altering the range of height extension for the embodiments of the present invention, the present invention provides the capability of standardization of component parts. The advantage of component standardization is that the leg support pole 122 is attached to the stilt extendible strut at a distance below the shoe plate 102 that can be the same for all sizes of stilts. Thus, the inner and outer sleeves 124, 126 are the same length for all stilt heights. This provides substantial weight and material savings on taller, normally heavier stilt sizes. Also, the in and out adjustment of the side leg support and the leg band is consistent for the stilts. Before the present invention, all stilt side leg supports and leg bands had diminishing in and out (lateral) comfort adjustment as the stilt sizes became taller because the side leg support lower connection was referenced from the bottom of the stilts.

A benefit of the stilt device of the present invention, in which the spring brackets, actuator bracket, and spring assemblies are referenced from the approximate same distance from the shoe plate for all sizes (heights) of stilts, is that the same tooling can be used to perforate bracket holes in the support extendible struts and attaching brackets for the stilts. Also, the weight of brackets and spring mechanism are disposed higher on stilts, yielding a higher center of gravity on taller stilts. Thus, there is less lever arm weight leverage to the legs of the wearing workman while walking.

A further benefit of the embodiments of the present invention, compared to prior art stilts, is that the front and rear extendible struts are circular, oval or otherwise of symmetrical cross section, and the rivets or fastening means that secure the brackets 170 to the extendible struts are flush with, or recessed from, the inside surface of the members 108A. Thus, the extension members 108B, 110B need not have a cross section with a clearance profile, such as a continuous longitudinal groove, to allow the free passage of the extension members 108B, 110B along the entire length of the members 108A, 110A. This allows the inner extension members to pass by the bracket connections without being restricted by the fasteners. The weight of the front and rear extendible struts 108, 110 are reduced since there is no need for a longitudinal rivet channel, which reduces the cross-sectional area.

Also by making the inside of the members 108A, 110A smooth and free of protrusions or rivet projections, the extension members 108B, 110B can have the same profile and be just enough smaller to slidably fit into the outer members 108A, 110A with just a very thin sleeve or bearing gap clearance. By making both outer and inside members of the same profile shape with the inside member just a material thickness plus a thin sleeve smaller, extendible strut construction is more efficient and lighter, while retaining adequate strength, than in the past. Also, by making it possible to have the inside adjustment tube the same profile shape but just smaller it becomes much easier to swage or expand one end and to fit the same end bracket as the larger outer tube and therefore use only one size end bracket to fit all leg ends.

Figure 7A:
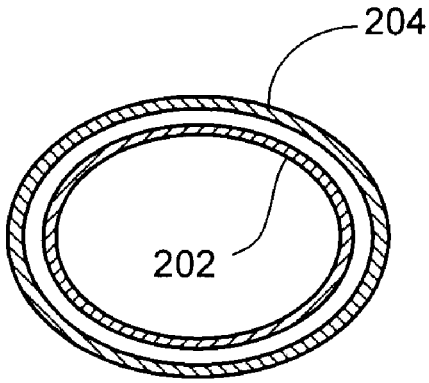
FIG. 7A is a sectional view of a strut assembly having inner and outer members that have oval cross sectional shapes.
Figure 7B:
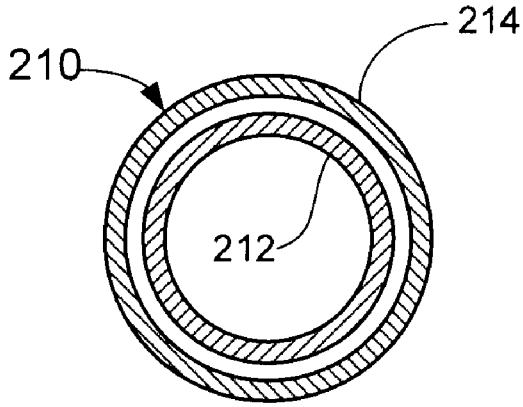
FIG. 7B is a sectional view of a strut assembly having cylindrically shaped inner and outer members that have circular cross sectional shapes.

In illustration of the above, FIG. 7A shows a strut assembly 200 that can be utilized in the devices set forth above with respective inner and outer tubular members 202, 204. The members 202, 204 have a curvilinear cross sectional shape characterized as an oval shape. FIG. 7B shows a strut assembly 210 that can alternatively utilized in the devices set forth above with respective inner and outer tubular members 212, 214. The members 212, 214 have a curvilinear cross sectional shape characterized as a circular shape.

It will be appreciated from a review of FIGS. 7A-7B that the outer members 204, 214 each have a respective first radius of curvature, and the inner members 202, 212 each have a respective second radius of curvature that is less than the first radius. It will further be appreciated that the clearance distances shown in FIGS. 7A-7B between the inner and outer members 202, 204 and 212, 214 have been exaggerated for clarity of illustration, so that the inner tubular members will preferably be sized to freely slidingly engage within the outer tubular members without either binding or excessive play.

FIG. 8 illustrates attachment of a portion of the damping assembly to the outer tubular member 204 of FIG. 7A via a rivet 180 such as discussed previously in FIG. 5A. A suitable tool such as represented at 218 is used to support the deformation of the rivet 180 so as to be recessed within the wall thickness of the member 204. As noted above, the brackets 170 are secured to the extendible struts in this way so that the rivets are flush with, or recessed from, the inside surface of the outer tubular members.

Thus, as mentioned, the inner tubular extension members need not have a cross section with a clearance profile, such as a continuous longitudinal groove, to allow the free passage of the tubular extension members along the entire length of the tubular members. This allows the inner tubular extension members to pass by the bracket connections without being restricted by the fasteners.

Also by making the inside of the tubular members 108A, 110A smooth and free of protrusions or rivet projections, the tubular extension members 108B, 110B can have the same profile and be just enough smaller to slidably fit into the outer tubular members 108A, 110A with just a very thin sleeve or bearing gap clearance. By making both outer and inside tubular members of the same profile shape with the inside tubular member just a material thickness plus a thin sleeve smaller, extendible strut construction is more efficient and lighter, while retaining adequate strength, than in the past. And, as mentioned above, by making the inside adjustment tube the same profile shape but just smaller, it is easier to expand one end and to fit the same end bracket as the larger outer tube and to use a one size end bracket to fit all leg ends.

It will also be noted that an advantage of the oval curvilinear members (such as 202, 204 in FIG. 7A) is that the oval cross sectional shape serves as a guide feature to maintain the inner tubular member 202 in a desired angular orientation with respect to the outer tubular member 204. Of course, as may be desired, the present invention can be provided with additional features.

One feature of the embodiments of the present invention is that of permitting the making of stilts for much greater heights than has heretofore been practical. Such greater heights are needed in such instances as that of building structures and of other applications requiring greater workman floor reach. For example, as the height of ceilings have increased with the changes in style and construction trends, there has been a need for taller articulating leg extension devices to service the needs of such construction. Also, certain segments of the horticultural industry have been needing taller stilts in order to harvest some crops, such as rack supported tomato plants.

Heretofore taller stilts have not been practical due to weight, security, comfort and function considerations. Comfort and security have been addressed in my U.S. Pat. No. 7,108,640. The embodiments described herein above, in addition to the features previously recognized herein, relate to improved weight and function and make utilization of taller articulating leg extension stilts practical.

The prior articulating leg extension stilt art utilized damping springs (such as the upper and lower damping springs 114, 116 described herein above) that were virtually the same for the forward motion and rearward motion of the stilt, although it was recognized that a more natural feeling of stilt walking was achieved by stiffening the upper spring over that of the lower spring.

It has been found that taller articulating stilts require springs that are distinctly different in that it is required that both the upper and lower springs of the damping assembly are not only stronger (stiffer) but that there is a decidedly different force and length requirement for the forward motion upper spring than the rearward motion lower spring. For safety and function, the utilization of taller stilts require that the forward motion upper spring be longer and appreciably stronger than the lower spring.

For an articulating leg extension stilt operating in the required height range of between 33 inches to 64 inches having a damping assembly incorporating an adjustable upper spring for forward motion and an adjustable second lower spring for rearward motion, the upper spring preferably operates to a compressing force range of about 70 to 120 pounds and the lower spring preferably operates to a force range of about 40 to 80 pounds.

The upper and lower springs of the damping assembly have usually been made from stainless steel extruded music wire, the upper spring wire having a diameter of about 0.115 inch and the lower spring wire having a diameter of about 0.110 inch. For the taller stilts with a height range of between 33 inches to 64 inches, these dimensions are preferably increased so that the upper spring wire has a diameter of about 0.145 inch and the lower spring wire having a diameter of about 0.125 inch.

These and various other features and alternatives will readily occur to the skilled artisan in view of the foregoing discussion.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed.

What is claimed is:

1. An article of manufacture comprising:

a shoe plate configured to support a foot of a user;

a floor plate configured to contactingly engage a floor surface;

a longer outer strut member and a shorter outer strut member each respectively configured to alternatively extend in a substantially vertical direction to couple the shoe plate to the floor plate, the shorter outer strut member having a first overall length and the longer outer strut member having a second overall length greater than the first overall length; and a leg attachment assembly configured to support a leg of the user, the leg attachment assembly comprising a leg band portion which contactingly engages the leg of the user and a leg extension pole having a proximal end connected to the leg band portion and an opposing distal end configured to be alternatively connected to the longer outer strut member or the shorter outer strut member at a common vertical distance from the shoe plate;

wherein the article of manufacture is characterized as a kit of parts configured to be alternatively assembled into a first stilt using the shorter strut member or into a second stilt using the longer strut member, wherein the first stilt has a shorter overall height than the second stilt, and wherein the leg support pole is attached at the same common vertical distance from the shoe plate in both the first and second stilts.

2. The article of manufacture of claim 1, wherein:

the longer outer strut member is characterized as a first longer strut member and the shorter outer strut member is characterized as a first shorter strut member;

the article of manufacture further comprises a second longer strut member and a second shorter strut member;

the first and second longer strut members configured to extend between the shoe plate and the foot plate in a spaced-apart parallelogram arrangement with a first biasing assembly connected therebetween to bias the first and second longer strut members in a substantially upright arrangement;

the first and second shorter strut members configured to extend between the shoe plate and the foot plate in a spaced-apart parallelogram arrangement with a second biasing assembly connected there between to bias the first and second shorter strut members in a substantially upright arrangement; and the first and second biasing assemblies each located a second common vertical distance from the shoe plate.

3. The article of manufacture of claim 1 further comprising:

a longer inner extension member which telescopically extends into the longer outer strut member;

a shorter inner extension member which telescopically extends into the shorter outer strut member; wherein a proximal end of the longer outer strut member is configured for attachment to the shoe plate and a distal end of the longer outer strut member is configured for sliding receipt of the longer inner extension member;

a proximal end of the shorter outer strut member is configured for attachment to the shoe plate and a distal end of the shorter outer strut member is configured for sliding receipt of the shorter inner extension member; and the longer outer strut member and the shorter outer strut member each having an attachment aperture at the common vertical distance from the respective proximal ends thereof to alternatively receive attachment and the leg extension pole.

4. The article of manufacture of claim 3, wherein:

the longer outer strut member has a longer overall length than an overall length of the shorter outer strut member; and the longer inner extension member has a longer overall length than an overall length of the shorter inner extension member.

5. The article of manufacture of claim 1, wherein the shorter strut member is adjustable over a first height range and the longer strut member is adjustable over a second height range, wherein a maximum height of the first range corresponds to the first overall length and a maximum height of the second range corresponds to the second overall length.

6. The article of manufacture of claim 5, wherein the first height range does not overlap the second height range.

7. The article of manufacture of claim 1, further comprising a strap coupled to the shoe plate to secure the foot of the user to the shoe plate.

8. The article of manufacture of claim 1, further comprising a leg extension pole bracket configured to respectively interconnect the distal end of the leg extension pole to the longer strut member or the shorter strut member at the same common vertical distance from the shoe plate.

9. The article of manufacture of claim 1, wherein the leg extension pole has an outer tubular portion which telescopically receives an inner tubular portion to accommodate a continuous extension.

10. The article of manufacture of claim 1 characterized as a stilt having a damping assembly having an adjustable upper spring for forward motion and an adjustable lower spring for rearward motion, the upper spring operating to a force range of about 70 to 120 lbs and the lower spring operating to a force range of about 40 to 80 lbs.

11. A stilt device for extending a workman's height above a base support surface formed from a kit of parts, comprising:

a first extendible strut comprising a first member and a cooperating first extension member having one end extending within the first member;

a second extendible strut comprising a second member and a cooperating second extension member having one end extending within the second member, the first extendible strut disposed parallel to and spaced apart from the second extendible strut;

a base member pivotally secured to the lower ends of the first and second extension members;

a shoe plate attachable to a person's shoe and secured to the upper ends of the first and second members and substantially parallel to the base member;

damping means for positioning the first and second extendible struts in a parallelogram relationship and for biasing the first and second extendible to assume an upright position;

a leg attachment assembly configured to support a leg of the user, the leg attachment assembly comprising a leg clamp contactingly engageable with the leg of the user; and a leg support pole connected to the leg clamp portion and connected to the first extendible strut at a common vertical distance from the shoe plate so that such vertical distance is unchanged by the extension or lengths of the first and second strut members.

12. The stilt device of claim 11 wherein the leg clamp comprises:

means for connecting to the person's leg.

13. The stilt device of claim 11 wherein the damping means has an adjustable upper spring for forward motion and an adjustable lower spring for rearward motion, the upper spring operating to a force range of about 70 to 120 lbs and the lower spring operating to a force range of about 40 to 80 lbs.

14. A kit of parts to form a stilt device for extending a workman's height above a support surface, comprising:

a. a first extendible strut comprising a first member and a cooperating first extension member having one end slidably extending within the first member;

b. a second extendible strut comprising a second member and a cooperating second extension member having one end slidably extending within the second member, the first extendible strut disposed parallel to and spaced apart from the second extendible strut;

c. a base member pivotally secured to the lower ends of the free ends of the first and second extension members;

d. a shoe plate for attaching to a person's shoe and having each end thereof pivotally secured to the free ends of the members of the first and second struts, said shoe plate being disposed substantially parallel to the base member;

e. damping means operably connected to the members for cushioning the pivotal movement of the struts and biasing the struts to an upright position;

f. a leg attachment assembly comprising a leg support pole connectable to a leg of the workman and connected to the first extendible strut at a common vertical distance from the shoe plate so that such vertical distance is unchanged by the extension of the first and second strut members or by the lengths of the first and second members.

15. The stilt device of claim 14 wherein the leg attachment assembly comprises:

clamp means for attaching the leg support pole to the user's leg to stabilize the user's stance.

16. The stilt device of claim 14 wherein the leg attachment assembly means comprises:

means for attaching a medial portion of the leg support pole to the shoe plate.

17. The stilt device of claim 14 wherein the damping means has an adjustable upper spring for forward motion and an adjustable lower spring for rearward motion, the upper spring operating to a force range of about 70 to 120 lbs and the lower spring operating to a force range of about 40 to 80 lbs.

18. A kit of parts adapted to form a stilt device for supporting a workman at a greater height above a support surface, comprising:

a base member configured for contacting engagement against the support surface;

a shoe plate configured for attachment to a shoe worn on a foot of the workman; and a telescopic strut assembly coupled between the base member and the shoe plate to selectively elevate the shoe plate above the base member, the strut assembly comprising:

first and second outer members each having a cross sectional shape and extending downwardly from the shoe plate;

first and second inner members each having a cross sectional shape and extending upwardly from the base member, wherein the first and second inner members are characterized as leg extension members for sliding engagement within the respective first and second outer members and for fixed engagement therein at a plurality of different height adjustment settings; and a damping assembly connected between the first and second outer members to maintain the first and second outer members biased in a nominally vertical orientation and to facilitate movement of the first and second outer members in a parallelogram fashion as the workman advances the shoe plate with respect to the base member, a leg attachment assembly comprising a leg support pole connectable to a leg of the workman and connected to the telescopic strut assembly at a common vertical distance from the shoe plate so that such vertical distance is unchanged by the height adjustment setting of the telescopic strut assembly or by the lengths of the outer and inner members.

19. The stilt device of claim 18, wherein the respective cross sectional shapes of the first and second outer members and the first and second inner members are substantially circular, wherein the first and second outer members are at a first radius and the first and second inner members are at a second radius smaller than the first radius to facilitate said sliding engagement of the first and second inner members into the respective first and second outer members.

20. The stilt device of claim 18, further comprising respective guide features associated with the first and second inner members to maintain a selected angular orientation of the first and second inner members with respect to the first and second outer members during sliding engagement.

21. The stilt device of claim 19, wherein the respective curvilinear cross sectional shapes of the first and second outer members and the first and second inner members are substantially oval, wherein the first and second outer members comprise a first radius and the first and second inner members comprise a second radius smaller than the first radius to facilitate said sliding engagement of the first and second inner members into the respective first and second outer members.

22. The stilt device of claim 19, further comprising a recessed rivet in a sidewall of each of the first and second outer members to adjoin the damping assembly thereto, the recessed rivet facilitating said sliding engagement of the respective first and second inner members without mechanical interference therewith.

23. The stilt device of claim 19, further comprising third and fourth inner members each having a curvilinear cross sectional shape and configured for extension upwardly from the base member, wherein the third and fourth inner members are characterized as leg extension members for sliding engagement within the respective first and second outer members and for fixed engagement therein at a plurality of different height adjustment settings in lieu of the first and second inner members, wherein the first and second inner members have a first length to provide a first range of height adjustments for the stilt device, and wherein the third and fourth inner members have a different second height to provide a different second range of height adjustments for the stilt device, and wherein the damping assembly remains in a fixed distance from the shoe plate irrespective of whether the first and second or the third and fourth inner members are installed.

24. The stilt device of claim 18 wherein the damping means has an adjustable upper spring for forward motion and an adjustable lower spring for rearward motion, the upper spring operating to a force range of about 70 to 120 lbs and the lower spring operating to a force range of about 40 to 80 lbs.

25. The article of manufacture of claim 1, in which the distal end of the leg extension pole curvilinearly extends in a direction toward the respective longer outer strut member or the shorter outer strut member and is attached thereto using a fastener which extends through opposing ear extensions of a yoke bracket.

26. The stilt device of claim 11, in which the leg attachment assembly further comprises a yoke bracket affixed to the first extendible strut, the yoke bracket comprising opposing ear extensions which pass adjacent opposing sides of a distal end of the leg support pole.

27. The stilt device of claim 26, in which the distal end of the leg support pole curvilinearly extends in a direction toward the yoke bracket.

28. The stilt device of claim 27, in which said distal end of the leg support pole is affixed to the respective ear extensions of the yoke assembly using a fastener which respectively extends through the ear extensions and said distal end to facilitate rotation of the leg support pole about said fastener and relative to said ear extensions.

* * * * *